United States Patent [19]

Takamiya et al.

[11] Patent Number: 4,801,527

[45] Date of Patent: Jan. 31, 1989

[54] PRESENSITIZED O-QUINONE DIAZIDE PLATE HAVING AN ANODIZED ALUMINUM BASE WITH AN AMINE COMPOUND CONTAINING HYDROPHILIC LAYER

[75] Inventors: Shuiti Takamiya; Hirokazu Sakaki, both of Shizuoka, Japan

[73] Assignee: Fuji Photo Film Co., Ltd., Kanagawa, Japan

[21] Appl. No.: 42,619

[22] Filed: Apr. 21, 1987

Related U.S. Application Data

[63] Continuation of Ser. No. 691,796, Jan. 16, 1985, abandoned.

[30] Foreign Application Priority Data

Jan. 17, 1984 [JP] Japan ..... 59-6050
May 4, 1984 [JP] Japan ..... 59-89627

[51] Int. Cl.[4] ..... G03C 1/94; G03C 1/54

[52] U.S. Cl. ..... 430/166; 430/165; 430/191; 430/278; 430/302; 430/331

[58] Field of Search ..... 430/278, 165, 166, 191, 430/302, 331

[56] References Cited

U.S. PATENT DOCUMENTS

| | | | |
|---|---|---|---|
| 3,350,206 | 10/1967 | Leonard | 430/278 |
| 3,549,365 | 12/1970 | Thomas | 430/278 |
| 3,554,751 | 1/1971 | Thomas | 430/159 |
| 3,756,826 | 9/1973 | Zelleg | 430/278 |
| 3,824,159 | 7/1974 | Wehrman et al. | 204/58 |
| 3,860,426 | 1/1975 | Cunningham et al. | 430/278 |
| 4,196,003 | 9/1980 | Watanabe | 430/191 |
| 4,267,260 | 5/1981 | Miura et al. | 430/302 |
| 4,275,092 | 6/1981 | Nakayama et al. | 430/302 |
| 4,292,095 | 9/1981 | Schlinsog | 148/6.14 R |
| 4,355,096 | 10/1982 | Walls | 430/302 |
| 4,370,404 | 1/1983 | Tachikawa et al. | 430/309 |
| 4,427,765 | 1/1984 | Mohr et al. | 430/166 |
| 4,427,766 | 1/1984 | Mohr | 430/166 |
| 4,446,221 | 5/1984 | Herting et al. | 430/278 |
| 4,467,028 | 8/1984 | Huang et al. | 430/278 |
| 4,469,776 | 9/1984 | Matsumoto et al. | 430/331 |
| 4,530,895 | 7/1985 | Simon et al. | 430/331 |
| 4,579,811 | 4/1986 | Schell et al. | 430/302 |
| 4,594,306 | 6/1986 | Stahlhofer et al. | 430/166 |
| 4,606,995 | 8/1986 | Kita et al. | 430/165 |

*Primary Examiner*—Charles L. Bowers, Jr.
*Attorney, Agent, or Firm*—Sughrue, Mion, Zinn, Macpeak & Seas

[57] ABSTRACT

A presensitized plate for use in making a planographic printing plate is described, comprising an aluminum plate having an anodized film layer, a hydrophilic layer provided on said anodized film layer and a lithographically suitable light-sensitive layer on said hydrophilic layer, said hydrophilic layer comprising a hydrophilic compound having at least one amino group and at least one group selected from the class consisting of a carboxyl group in the free acid form or salt form, a sulfo group in the free acid form or salt form, and a hydroxyl group has prolonged life on the printing press and at the same time is resistant to scumming on non-image areas.

11 Claims, No Drawings

PRESENSITIZED O-QUINONE DIAZIDE PLATE HAVING AN ANODIZED ALUMINUM BASE WITH AN AMINE COMPOUND CONTAINING HYDROPHILIC LAYER

This is a continuation of application Ser. No. 06/691,796, filed Jan. 16, 1985, now abandoned.

FIELD OF THE INVENTION

This invention relates to a presensitized plate and, more particularly, to a presensitized plate having an anodized aluminum base having an improved hydrophilic layer.

BACKGROUND OF THE INVENTION

The so-called presensitized plate (abbreviated as "PS plate" hereinafter) comprises an aluminum plate coated with a light-sensitive composition in the form of a thin layer known for planographic printing plates. Generally, said aluminum plate is subjected to a surface roughening treatment, for example, by mechanical means (e.g., brush graining, ball graining), by electrochemical means (e.g., electrolytic graining), or by a combination of both means to make the surface mat. The plate is then etched with, for instance, an aqueous solution of an acid or alkali, then anodized, and, if desired, subjected to further treatment for rendering the plate surface hydrophilic. The thus-prepared support, when provided with a light-sensitive layer thereon, constitutes a PS plate. This PS plate is generally subjected to the steps of exposure for image formation, development, and gumming-up, to provide a planographic printing plate. This is mounted on a printing press, and printing is conducted therewith.

With the above sort of planographic printing plate, however, non-image areas of the planographic printing plate obtained from a positive-working PS plate through exposure and development are typically contaminated by substances contained in the light-sensitive layer which are strongly adsorbed on said areas. As a result, it becomes difficult to discriminate image areas from non-image areas in the step of retouching, or traces of retouches remain distinctly, giving an uneven printing face or, in extreme cases, leading to stains on prints which render the printing plate unusable.

To improve the above situation, several methods have been developed for preventing the above-mentioned contamination of non-image areas, in order to thereby minimize or prevent the formation of stains on prints. For example, one method comprises treating the surface of an anodized aluminum support by dipping said support in an alkali metal silicate solution, as described in U.S. Pat. No. 3,181,461. Another method comprises subbing said anodized surface with a hydrophilic cellulose containing a water-soluble zinc salt, as described in U.S. Pat. No. 3,860,426. A further method comprises subbing said surface with the sodium salt of an arylsulfonic acid, as described in British Pat. No. 2,098,627. Although the process prevents stains at non-image areas, such methods have created a new problem, in that the press life of the printing plate, i.e., the number of prints producible with said plate, is decreased by from 20 to 50% as compared to the case wherein such treatment is not applied.

In the case of a negative-working PS plate, another problem is that a planographic printing plate obtained after exposure and development has a decreased adhesion between the image-carrying areas and the support, also with the effect that the printing plate cannot be used in printing a large number of copies.

To overcome the above problems, several methods have been proposed. For instance, Japanese Patent Publication No. 6410/69 discloses a method for providing the surface of an anodized aluminum support with a thin layer of a trihydroxybenzenecarboxylic acid. According to Japanese Patent Publication No. 14337/66, said surface is provided with a thin layer of mellitic acid. Japanese Patent Publication No. 8907/63 describes a method of providing said anodized surface with a thin layer of a phosphonic acid or a derivative thereof. However, while such methods can improve the above-mentioned adhesion of image-carryign areas, they have offered a new problem. The problem is that the degree of staining of the non-image areas becomes very significant as compared with the case wherein the above-mentioned methods are not applied. In particular, such problem becomes severer with the lapse of time after preparation of the PS plate until preparation of the planographic printing plate.

SUMMARY OF THE INVENTION

An object of the invention is to provide a support for use in a planographic printing plate, with which a planographic printing plate resistant to scumming of non-image areas can be obtained without decreasing its press life in printing.

A further object of the invention is to provide a support for use in a planographic printing plate, with which a planographic printing plate resistant to scumming of non-image areas can be obtained while maintaining strong adhesion between lipophilic image areas and the support.

As a result of intensive studies to achieve the above objects, the present inventors have now achieved the present invention, which is directed to a planographic printing plate support comprising an aluminum plate having an anodized film layer and a hydrophilic layer comprising a compound having at least one amino group and at least one group selected from the class consisting of a carboxyl group in the free acid form or salt form, a sulfo group in the free acid form or salt form, and a hydroxyl group.

DETAILED DESCRIPTION OF THE INVENTION

The aluminum plate to be used in the practice of the invention is a plate-like body made of substantially pure aluminum or an aluminum alloy containing a small amount of one or more other elements. Said other elements include silicon, iron, manganese, copper, magnesium, chromium, zinc, bismuth, nickel, and titanium, among others. The alloy contains such othter element(s) in a total amount of not more than 10% by weight. To be best suited for use in the practice of the invention, the aluminum should preferably be pure aluminum. However, completely pure aluminum is difficult to produce from the refining technology viewpoint. Therefore, it is preferable that the aluminum should be as free from other elements as possible. Aluminum alloys with a content of other elements within the above-mentioned range are useful in the practice of the invention. The composition of the aluminum plate to be used in practicing the invention is not limited, but any of materials conventionally known or in use in the art may be used.

The aluminum plate to be used in the practice of the invention generally has a thickness of about 0.1 mm to 0.5 mm. Prior to anodization, the aluminum plate may be subjected, if desired, to degreasing treatment with a surfactant or an aqueous alkaline solution to thereby remove rolling oil on the surface thereof. Thereafter, the aluminum plate may be grained in a conventional manner such as mechanical graining, chemical graining or electrochemical graining.

The mechanical graining includes ball graining, brush graining, blast graining, and buff polishing. Electrochemical graining can be conducted in a hydrochloric or nitric acid-containing electrolyte solution using an alternating or direct current. The mechanical and electrochemical graining methods may be combined as disclosed in U.S. Pat. Nos. 4,476,006 and 4,477,317.

The aluminum plate with its surface grained in the above manner is then subjected, if desired, to alkali etching and neutralization.

The thus-treated aluminum plate is anodized. Electrolytes that can be used in the anodizing treatment include sulfuric acid, phosphoric acid, oxalic acid, chromic acid, and mixtures thereof, and the concentration of the electrolyte is selected depending on the kind of electrolyte. The anodizing conditions may vary depending on the particular electrolyte used. Generally, however, the following are appropriate: an electrolyte concentration within the range of from 1 to 80% by weight; an electrolyte solution temperature within the range of 5° to 70° C.; a current density within the range of 5 to 60 A/dm$^2$; a voltage within the range of from 1 to 100 V; and an electrolysis period within the range of from 10 seconds to 50 minutes.

The amount of the anodized layer is preferably in the range of from 0.1 to 10 g/m$^2$, and more preferably from 1 to 6 g/m$^2$.

The support for use in a planographic printing plate in accordance with the invention is obtained by providing the anodized layer on the aluminum plate as obstined after such treatments as mentioned above with a hydrophilic layer by applying a solution of the hydrophilic compound mentioned, as described further below, in water or an organic solvent, such as methanol, followed by drying.

The hydrophilic compound to be used in the practice of the invention is a compound having (1) at least one amino group (inclusive of primary, secondary, and tertiary amino groups) and (2) at least one group selected from among a carboxyl group either in the free form or in the salt form, a sulfo group either in the free form or in the salt form, and a hydroxyl group. Said hydrophilic compound may have a further hydrophilic group other than the above-mentioned hydrophilic groups (1) and (2).

Such hydrophilic compound preferably has a molecular weight of not more than 1,000.

Examples of the hydrophilic compound which are useful are monoamino-monocarboxylic acids such as aminoacetic acid and alanine; oxyamino acids such as serine, threonine and dihydroxyethylglycine; sulfur-containing amino acids such as cysteine and cystine; monoaminodicarboxylic acids such as aspartic acid and glutamic acid; diamino-monocarboxylic acids such as lysine; aromatic nucleus-containing amino acids such as p-hydroxyphenylglycine, phenylalanine and anthranilic acid; heterocycle-containing amino acids such as tryptophan and proline; sulfamic acid and aliphatic aminosulfonic acids such as cyclohexylsulfamic acid; (poly)aminopolyacetic acids such as ethylenediaminetetraacetic acid, nitrilotriacetic acid, iminodiacetic acid, hydroxyethyliminodiacetic acid, hydroxyethylethylenediaminetriacetic acid, ethylenediaminediacetic acid, cyclohexanediaminetetraacetic acid, diethylenetriaminepentaacetic acid and glycol ether diaminetetraacetic acid, and the sodium, potassium and ammonium salts of these, inclusive of those in which the acid groups are wholly or partly in the salt form; as well as alkanolamines, such as monoethanolamine, diethanolamine, triemthanolamine, tripropanolamine and triethanolamine, and the hydrochloride, oxalate, phosphate and other salts thereof. Among them, most preferred are dihydroxyethylglycine, hydroxyethylethylenediaminetriacetic acid, hydroxyethyliminodiacetic acid, triethanolamine and triethanolamine hydrochloride.

The subbing solution is generally prepared by dissolving such hydrophilic compound in water or an alcohol such as methanol to a concentration of from 0.001 to 10% by weight. An appropriate pH of the coating solution lies in the range of from 1 to 13. The coating solution preferably has a temperature within the range of from 10° to 50° C.

The above subbing solution may be applied, e.g., in the manner of dipping, rotational coating, roller coating, spraying, or curtain coating.

The coating amount is preferably from 1 to 100 mg/m$^2$, and more preferably within the range of from 5 to 50 mg/m$^2$, on a dry basis.

When the coating amount is less than 1 mg/m$^2$, the effect of preventing scumming of non-image areas tends to become insignificant. On the other hand, when the coating amount exceeds 100 mg/m$^2$, the adhesion between the light-sensitive layer and the support tends to become deteriorated, whereby a planographic printing plate having a poor printing press life is obtained.

Before or after providing such hydrophilic layer, the anodized aluminum plate may be treated with an aqueous alkali metal silicate (e.g., sodium silicate) solution, as described in U.S. Pat. No. 3,181,461.

On the thus-obtained support for a planographic printing plate, a lithographically suitable light-sensitive layer as conventionally known in the art is provided as the light-sensitive layer of a PS plate, to give a light-sensitive planographic printing plate. After the plate making treatment, the planographic printing plate has excellent performance characteristics.

As the composition of the above-mentioned light-sensitive layer, any one may be used which, upon exposure, changes in its solubility or degree of swelling in a developing solution. The following are typical examples:

(1) Positive working light-sensitive composition comprising an o-quinonediazide compound:

Preferred positive-working light-sensitive diazo compound include the ester formed between benzoquinone-1,2-diazide-sulfonic acid chloride and a polyhydroxybenzene or between naphthoquinone-1,2-diazide-sulfonic acid chloride and a pyrogallol-acetone resin, as described in U.S. Pat. No. 3,635,709. Another comparatively suitable o-quinonediazide compound is the ester formed between benzoquinone-1,2-diazide-sulfonic acid chloride or naphthoquinone-1,2-diazide-sulfonic acid chloride and a phenol-formaldehyde resin, as described in U.S. Pat. Nos. 3,046,120 and 3,188,210.

Although such o-quinonediazide compound, even when used alone, can constitute a light-sensitive layer, such kind of resin is generally used in combination with a resin soluble in an aqueous alkali solution which serves as a binder. Examples of the alkali-water-soluble resin are novolak resins such as phenol-formaldehyde resin, cresol-formaldehyde resin, p-tert-butylphenolformaldehyde resin, phenol-modified xylene resin, and phenol-modified xylene-mesitylene resin. Other useful alkali-water-soluble resins are polyhydroxystyrene, poly(halogenated hydroxystyrene), and copolymers of (meth)acrylic acid and other vinyl compounds.

Further particulars of the light-sensitive layer comprising an o-quinonediazide compound and a developing solution therefor are described in U.S. Pat. No. 4,259,434.

(2) Light-sensitive composition composed of diazo resin and binder:

As a negative-working light-sensitive diazo compounds, the condensation product (the so-called light-sensitive diazo resin) from a diphenylamine-p-diazonium salt and formaldehyde is preferably used, which is typical of the condensation product from a diazonium salt and an organic condensing reactant having a reactive carbonyl group such as an aldol or acetal, as disclosed in U.S. Pat. Nos. 2,063,631 and 2,667,415. Additional useful condensed diazo compounds are disclosed in U.S. Pat. No. 3,679,419 and British Pat. Nos. 1,312,925 and 1,312,926. Light-sensitive diazo compounds of these types are generally obtained in the form of water-soluble inorganic salts and accordingly can be applied in the form of aqueous solutions. It is also possible to react these water-soluble daizo compounds with an aromatic or aliphatic compound having at least one phenolic hydroxyl group or sulfo group or both, as disclosed in British Pat. No. 1,280,885, for instance, and use the resulting substantially water-insoluble light-sensitive diazo resins.

It is also possible as described in Japanese Patent Application (OPI) No. 121031/81 (the term "OPI" as used herein refers to a "published unexamined Japanese patent application") to use the diazo compound in the form of a reaction product with hexafluorophosphate or tetrafluoroborate.

The diazo resins described in U.S. Pat. No. 1,312,925 are also preferable.

Such diazo resins are used in combination with a binder resin. Preferred binders include organic high polymers having an acid value of from 10 to 200, such as, for instance, copolymers containing acrylic acid, methacrylic acid, crotonic acid, or maleic acid as the essential monomer component, such as three-component or four-component copolymers from 2-hydroxyethyl acrylate or 2-hydroxyethyl methacrylate, acrylonitrile or methacrylonitrile, acrylic acid or methacrylic acid, and, if desired, a further copolymerizable monomer, such as described in U.S. Pat. No. 4,123,276; copolymers from the esterified acrylic acid or methacrylic acid with a group having a terminal hydroxyl group and containing a dicarboxylic acid ester residue, acrylic acid, or methacrylic acid and, if desired, a further copolymerizable monomer, such as disclosed in Japanese Patent Application (OPI) No. 120903/78; copolymers from a monomer having a terminal aromatic hydroxyl group (for example, N-(4-hydroxyphenyl)methacrylamide), acrylic acid or methacrylic acid and, if desired, at least one copolymerizable monomer, such as described in Japanese Patent Application (OPI) No. 98614/79; and copolymers from an alkyl acrylate or methacrylate, acrylonitrile or methacrylonitrile, and an unsaturated carboxylic acid, such as described in Japanese Patent Application (OPI) No. 4144/81. Acidic polyvinyl alcohol derivatives and acidic cellulose derivatives are also useful.

(3) Composition containing a compound capable of crosslinking upon irradiation with activating light:

Such compounds include, among others, polyvinyl cinnamate, polyvinyl ciannamoyl ethyl ether, polyethyl cinnamate acrylate and copolymers thereof, polyethyl cinnamate methacrylate and copolymers thereof, polyparavinylphenyl cinnamate and copolymers thereof, polyvinyl benzal acetophenone and derivatives thereof, polyvinyl cinnamylideneacetate and derivatives thereof, allyl acrylate prepolymer and derivatives thereof, and derivatives of polyester resins from paraphenylenediacrylic acid and a polyhydric alcohol, such as described in U.S. Pat. No. 3,030,208.

(4) Photopolymerizable composition capable of polymerizing upon irradiation with activating light:

Such compositions include, for example, a composition comprising an unsaturated compound having two or more terminal ethylene groups and capable of addition polymerization, and a photopolymerization initiator, such as described in U.S. Pat. Nos. 2,760,863 and 3,060,023.

To the above-mentioned compound capable of crosslinking or polymerizing under activating light irradiation, there may further be added a resin (as a binder) sensitizer, thermal polymerization inhibitor, colorant and/or plasticizer.

The above-mentioned light-sensitive composition is coated on the substrate of the present invention as a solution of water, an organic solvent or a mixture thereof and dried to form a light-sensitive planographic printing plate.

Generally, the light-sensitive composition is suitably applied in a coating amount of from about 0.1 to about 0.5 g/m$^2$, and preferably from about 0.5 to about 3.0 g/m$^2$, on a dry basis.

The thus-obtained light-sensitive planographic printing plate is subjected to image exposure using a light source capable of emitting actinic light, such as a carbon lamp, xenon lamp, mercury lamp, tungsten lamp or metal halide lamp, followed by development, to give a planographic printing plate ready for use in printing.

The planographic printing plate prepared by using the aluminum support according to the invention is markedly advantageous in that, as compared with the prior art plates, it has a much prolonged press life on the printing press and at the same time its non-image areas are resistant to scumming. In the prior art, those planographic printing plates which have a prolonged life on the printing press are susceptible to scumming on non-image areas thereof, whereas planographic printing plates which are resistsant to scumming on non-image areas conversely have a decreased press life on the printing press. It has thus been considered difficult to improve both of said performance characteristics at the same time.

In contrast, the planographic printing plate prepared by using the aluminum support according to the present invention has favorable properties which have so far never been attained, namely, prolonged life on the printing press as well as resistance to scumming on non-image areas.

The following examples illustrate the invention in further detail. In the examples, "%" means "% by weight" unless otherwise specified.

EXAMPLE 1

A JIS 1050 aluminum sheet was grained using a rotating nylon brush with an aqueous pumice suspension as the abrasive. The surface roughness attained (average roughness along the center line) was 0.5 micron. After rinsing with water, the sheet was immersed in a 10% aqueous sodium hydroxide solution warmed at 70° C. to thereby effect etching until the aluminum surface dissolution amounted to 6 g/m$^2$. After rinsing with water, the sheet was immersed in a 30% aqueous nitric acid solution for 1 minute for neutralization, followed by thorough rinsing with water. Thereafter, the sheet was subjected to electrolytic graining in a 0.7% aqueous nitric acid solution using a rectangular alternating current with an anode voltage of 13 volts and a cathode voltage of 6 volts (the power source waveform as described in U.S. Pat. No. 4,087,341 in the examples thereof), followed by dipping in 20% sulfuric acid maintained at 50° C. for surface washing and the subsequent rinsing with water.

The sheet was further anodized in 30% aqueous sulfuric acid using a direct current, to thereby attain an anodized film weight of 3.0 g/m$^2$, then rinsed with water and dried to give a substrate (I).

The thus-prepared substrate (I) was coated with a solution (I) having the composition given below, followed by drying at 80° C. for 30 seconds to give a substrate (II).

The coated weight after drying was 10 mg/m$^2$.

Solution (I)

| | parts by weight |
|---|---|
| Dihydroxyethylglycine | 0.05 |
| Methanol | 94.95 |
| Water | 5 |

Using sulfamic acid in lieu of dihydroxyethylglycine, the substrate (I) was coated with a solution (II) having the composition given below, followed by drying at 80° C. for 30 seconds to give a substrate (III).

The coated weight after drying was 10 mg/m$^2$.

Solution (II):

| | parts by weight |
|---|---|
| Sulfamic acid | 0.05 |
| Methanol | 94.95 |
| Water | 5 |

A further substrate (IV) was prepared by coating the above substrate (I) with a solution (III) having the composition given below, followed by drying at 80° C. for 30 seconds.

The coated weight after drying was 10 mg/m$^2$.

Solution (III):

| | |
|---|---|
| Triethanolamine | 0.05 g |
| Methanol | 94.95 g |
| Water | 5 g |

Using triethanolamine hydrochloride in lieu of triethanolamine, the substrate (I) was coated with a solution (IV) having the composition given below, followed by drying at 80° C. for 30 seconds, giving a substrate (V).

The coated weight after drying was 10 mg/m$^2$.

Solution (IV):

| | |
|---|---|
| Triethamolamine hydrochloride | 0.05 g |
| Methanol | 94.95 g |
| Water | 5 g |

For comparison, further substrates (VI) and (VII) were prepared by coating the substrate (I) with aqueous solutions of carboxymethyl cellulose (molecular weight: 25,000) and polyvinyl alcohol (molecular weight: 10,000), respectively (coated weight after drying: 10 mg/m$^2$).

The thus-prepared substrates (I) to (VII) were provided with a light-sensitive layer by coating with the composition given below to a coated weight (after drying) of 2.5 g/m$^2$.

| | |
|---|---|
| Ester compound from naphthoquinone-1,2-diazide-5-sulfonyl chloride and pyrogallol-acetone resin (as described in Example 1 of U.S. Pat. No. 3,635,709) | 0.75 g |
| Cresol novolak resin | 2.00 g |
| Oil Blue #603 (Orient Chemical) | 0.04 g |
| Ethylene dichloride | 16 g |
| 2-Methoxyethyl acetate | 12 g |

The thus-produced light-sensitive planographic printing plates were exposed, in a vacuum printing frame, to light through a positive transparency for 50 seconds by means of a 3 kw metal halide lamp placed 1 meter from said plates, followed by development using a 5.26% aqueous solution (pH 12.7) of sodium silicate with an $SiO_2/Na_2O$ mole ratio of 1.74.

After development, the plates were rinsed well with water, gummed, and used in printing in the conventional manner. Scumming on non-image areas on the printed papers and press life on the printing press (in terms of number of copies obtained) were examined. The results obtained are shown in Table 1.

The results shown in Table 1 indicate that the supports according to the invention are satisfactory in both press life on the printing press and scumming on non-image areas as compared with the supports in the comparative examples.

TABLE 1

| | Example | | | | Comparative Example | | |
|---|---|---|---|---|---|---|---|
| | 1 | 2 | 3 | 4 | 1 | 2 | 3 |
| Substrate | Substrate (II) | Substrate (III) | Substrate (IV) | Substrate (V) | Substrate (I) | Substrate (VI) | Substrate (VII) |
| Life on printing press | 150,000 copies | 150,000 copies | 150,000 copies | 150,000 copies | 150,000 copies | 80,000 copies | 70,000 copies |
| Scumming on | A | A | A | A | B | A | A |

TABLE 1-continued

| | Example | | | | Comparative Example | | |
|---|---|---|---|---|---|---|---|
| | 1 | 2 | 3 | 4 | 1 | 2 | 3 |
| non-image areas | | | | | | | |

Note:
A: No scumming occurred at all even when the quantity of fountain solution was decreased.
B: Scumming occurred when the quantity of fountain solution was decreased.

While the invention has been described in detail and with reference to specific embodiments thereof, it will be apparent to one skilled in the art that varioius changes and modifications can be made therein without departing from the spirit and scope thereof.

What is claimed is:

1. In a presensitized plate for use in making a planographic printing plate which comprises an aluminum plate having an anodized film layer, a hydrophilic layer provided on said anodized film layer and a lithographically suitable light-sensitive comprising a positive working light-sensitive composition containing an o-quinonediazide compound on said hydrophilic layer, the improvement wherein said anodized film layer is prepared using an electrolyte selected from the group consisting of sulfuric acid, phosphoric acid, oxalic acid, chromic acid, or a mixture thereof, and wherein said hydrophilic layer comprises a hydrophilic compound having (1) at laast one amino group and (2) at least one group selected from the class consisting of a carboxyl group in the free acid or salt form, a sulfo group in the free acid form or salt form, and a hydroxyl group.

2. A presensitized plate as in claim 1, wherein said compound further comprises a hydrophilic group other than an amino group and other than a group selected from the class consisting of a carboxyl group in the free acid form or salt form, a sulfo group in the free acid form or salt form, and a hydroxyl group.

3. A presensitized plate as in claim 1, wherein said compound has a molecular weight of not more than 1,000.

4. A presensitized plate as in claim 1, wherein said support comprises said hydrophilic layer coated in an amount of from 1 to 100 mg/m$^2$.

5. A presensitized plate as in claim 1, wherein said support comprises said hydrophilic layer coated in an amount of from 5 to 50 mg/m$^2$.

6. A presensitized plate as in claim 1, wherein said compound is selected from the group consisting of dihydroxyethylglycine, hydroxyethylethylene-diaminetriacetic acid, hydroxyethyliminodiacetic acid, triethanolamine, and triethanolamine hydrochloride.

7. A presensitized plate as in claim 6, wherein said support comprises said hydrophilic layer coated in an amount of from 1 to 100 mg/m$^2$.

8. A presensitized plate as in claim 6, wherein said support comprises said hydrophilic layer coated in an amount of from 5 to 50 mg/m$^2$.

9. A presensitized plate as in claim 1, wherein said positive working light-sensitive composition further contains a novolak resin.

10. A presensitized plate as in claim 9, wherein said compound is selected from the group consisting of oxyamino acids, diamino-moncarboxylic acids, heterocycle-containing amino acids and alkanol-amines.

11. A presensitized plate as in claim 9, wherein said compound is selected from the group consisting of dihydroxyethylglycine, lysine, triethanolamine, and triethanolamine hydrochloride.

* * * * *